US006484541B1

(12) United States Patent
Haag

(10) Patent No.: US 6,484,541 B1
(45) Date of Patent: Nov. 26, 2002

(54) SINKER SEGMENT

(75) Inventor: Gerd Haag, Dunningen-Seedorf (DE)

(73) Assignee: Hugo Kern und Liebers GmbH & Co. Platinen und Federnfabrik (DE)

( * ) Notice: Subject to any disclaimer, the term of this patent is extended or adjusted under 35 U.S.C. 154(b) by 0 days.

(21) Appl. No.: 09/857,546

(22) PCT Filed: Apr. 12, 2000

(86) PCT No.: PCT/EP00/03249

§ 371 (c)(1),
(2), (4) Date: Jun. 6, 2001

(87) PCT Pub. No.: WO00/68480

PCT Pub. Date: Nov. 16, 2000

(30) Foreign Application Priority Data

May 5, 1999 (DE) ..... 199 20 673

(51) Int. Cl.[7] ..... D04B 15/06
(52) U.S. Cl. ..... 66/104
(58) Field of Search ..... 66/90, 91, 92, 66/93, 104, 105, 106, 107, 108 R, 108 A, 109, 207, 204

(56) References Cited

U.S. PATENT DOCUMENTS

| | | | | | |
|---|---|---|---|---|---|
| 2,710,528 | A | * | 6/1955 | Cobert | 66/144 |
| 3,289,438 | A | * | 12/1966 | Kohl | 66/114 |
| 5,577,401 | A | * | 11/1996 | Pernick | 29/525 |
| 5,609,044 | A | * | 3/1997 | Tacy | 66/114 |
| 5,966,969 | A | | 10/1999 | Mista | |

FOREIGN PATENT DOCUMENTS

| | | | |
|---|---|---|---|
| DE | 232 938 A1 | 2/1986 | D04B/35/02 |
| DE | 197 53 590 C1 | 5/1999 | D04B/23/00 |

* cited by examiner

*Primary Examiner*—Danny Worrell
(74) *Attorney, Agent, or Firm*—Pendorf & Cutliff

(57) ABSTRACT

The invention relates to a sinker segment (1) for a textile loop. The sinker segment comprises a multitude of loop-forming elements (10) which are arranged in an equidistant manner, are aligned parallel, are joined in the area of a bottom section (12) by one or more strands (20) of a curable adhesive, and which can be directly fastened to the textile loop.

9 Claims, 1 Drawing Sheet

SINKER SEGMENT

Figure 2:
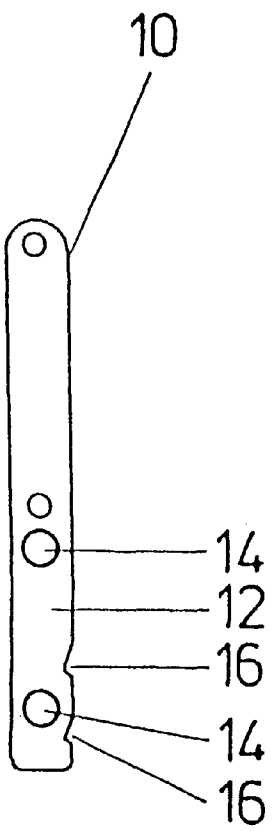

The invention concerns a sinker segment for a textile machine with a plurality of loop-forming elements, which are provided equidistant and oriented parallel and respectively connected to each other in the bottom section.

This type of segment is generally employed in jersey and shirt making machines, chain reciprocal action machines, double rib looms, croqueting hook machines, and Jacquard looms in order to produce the necessary thread positioning with respect to the knitting needles or weaving needles or, as the case may be, to guide threads over a dividing or spacing comb. For this, a large number of thread guiding elements, such as for example knitting needles or sinkers, are positioned close together equidistant from each other and oriented parallel and received by a holder.

The holder itself is designed corresponding to the receiving elements of the textile machine and can be releasably secured by simple means such as, for example, a screw. Frequently, holders with standardized breadths, particularly in the range of between ½ and ⅓ inch, are employed, which are provided in a row next to each other corresponding to the loop segment.

Until now generally segments are employed, of which the holders are comprised of a tin alloy and are produced in a pressure or injection casting method, wherein the loop forming elements are directly cast in. A disadvantage in this respect is the necessary complexity and expenditure of manufacture, since not only is it necessary to cast the holder in a mold, but rather the loop forming elements must manually be aligned or trued up in their final or end position.

Loop forming segments are also conventionally available, in which the case loop forming elements are introduced in a preformed carrier and are therein fixed via a hardenable adhesive. For this a notch is provided in the carrier, into which the loop forming elements are introduced and then fixed by pouring in of adhesive. The cost and complexity of manufacture is even higher in comparison to the above described loop forming segment, since the carrier must first be pre-manufactured and only subsequently can the loop forming elements be assembled thereon.

The two above discussed concepts suffer beyond this from the disadvantage, that the holder possesses a comparatively high mass or weight due to its massive cast construction, which has a definitely negative impact on the acceleration behavior. The tendency in the textile loop construction technology to always higher work speeds requires that the loop-forming segments be subjected to more rapid accelerations and decelerations. There is thus a need to keep the masses as low as possible, without detracting from the capacity of the segment, which is measured by the action of the thread thereon.

Finally, from DE 44 41 995 A1 it is known to construct the holder no longer out of cast parts, but rather in light construction, from a stamped part. The desired structural stability is achieved by angling or bending over the edge or rim segments which receive the eye-pointed needles in appropriately arranged comb-like segments.

This loop-forming segment also has however, now as before, the problem of a comparatively complex and expensive manufacture. It is an advantage that, on the basis of the highly precise manufacturing, it becomes possible to dispense with follow-up adjustment or alignment of the eye-pointed needle receiving slots. However, here also the carrier must be pre-manufactured as a separate construction component, meaning stamping and deformation.

The present invention is thus concerned with the problem of further developing a loop forming segment of the above described type, which no longer suffers from the above described disadvantages. In particular, a loop-forming segment should be produced for textile loops, which can be manufactured in simple and economical manner and, beyond this, exhibits a mass which is as low as possible.

The problem is solved by a loop forming segment exhibiting the characteristics of claim 1.

Advantageous embodiments of the loop forming segment are set forth in the characteristics of the dependent claims.

The invention is based upon the idea, of connecting or bonding appropriately spaced loop forming elements directly with each other using a construction adhesive material, and designing the bottom segment of the element in such a manner as to make possible the direct affixation onto the textile machine. It thus becomes possible to completely dispense with the hitherto conventionally employed holder, and its features make possible on the one hand a substantial reduction in the manufacturing costs, and on the other hand, as a result of the weight reduction associated therewith, makes possible a substantial reduction in the dynamic loading or inertial burden of the textile machine. As a welcome side benefit of the weight reduction, there is also a lowering of the noise emission of the machine, whereby a further saving potential surfaces since the legally mandated noise protecting measures may be dispensed with.

Exceptional benefits can be achieved when using two strands or extrusions of adhesive material arranged parallel to each other and provided oriented perpendicular to the longitudinal direction of extension of the loop forming elements. The longitudinal layout of the respective bottom segments must thereby be so selected, that the two adhesive strands can be provided spaced apart from each other.

Preferably, each of the base segments exhibits holes, through which the adhesive strands extend. This configuration has the advantage that the adhesive strands connecting the loop-forming elements are provided completely within the contour of the elements. Thereby a loop-forming segment is produced, which has an extremely flat construction, so that an extremely compacted loop-forming manner can be realized.

As the adhesive, particularly preferred is a construction adhesive, and in particular a two-component epoxy resin, which is excellent to use and after hardening meets the high requirements for strength.

Manufacturing can be carried out economically with the aid of a dosing device, via which the adhesive is extruded directly into the holes. Therewith basically only a receiving or inlay comb is needed, which receives the loop forming elements and positions them precisely, until the adhesive injected in the holes is hardened. The individual adhesive strands are so designed that the dosing device, in the case of loop forming elements positioned vertically one above the other, builds an adhesive bead, which begins at the lower most element and is built up upwards as the dosing device is raised upwards. The dosing of the amount of adhesive is precisely adjusted, depending upon the diameter of the holes and the rate of movement of the dosing device, so that no extraneous injection mold is required. Further, no kind of mechanical follow up working is required.

The direct securing of the self-standing segments formed in this manner occurs by a suitable geometric design of the base segment, so that for example a form-fitting lying flush against a notch or another suitable receptacle of the bar or billet of the machine results. This leads to an improved and easier serviceability during changing of spent segments.

This can be concretely achieved when, for example, in the area of the base segment, triangular shaped voids are provided, or recesses in the form of a dovetail.

It should be understood that, in accordance with the inventive concept, segments can be provided in any desired breadth and graduation or spacing. As elements, practically any of the variously known elements can be employed, such as for example thread comb sinkers, push sinkers, knitting sinkers, milled sheet sinkers or punch comb sinkers.

The invention will now be described on the basis of the illustrative embodiment shown schematically in the figures. There is shown FIG. 1 loop forming segment in top view, FIG. 2 loop forming segment according to FIG. 1, view from the left.

DETAILED DESCRIPTION OF THE INVENTION

Figure 1:
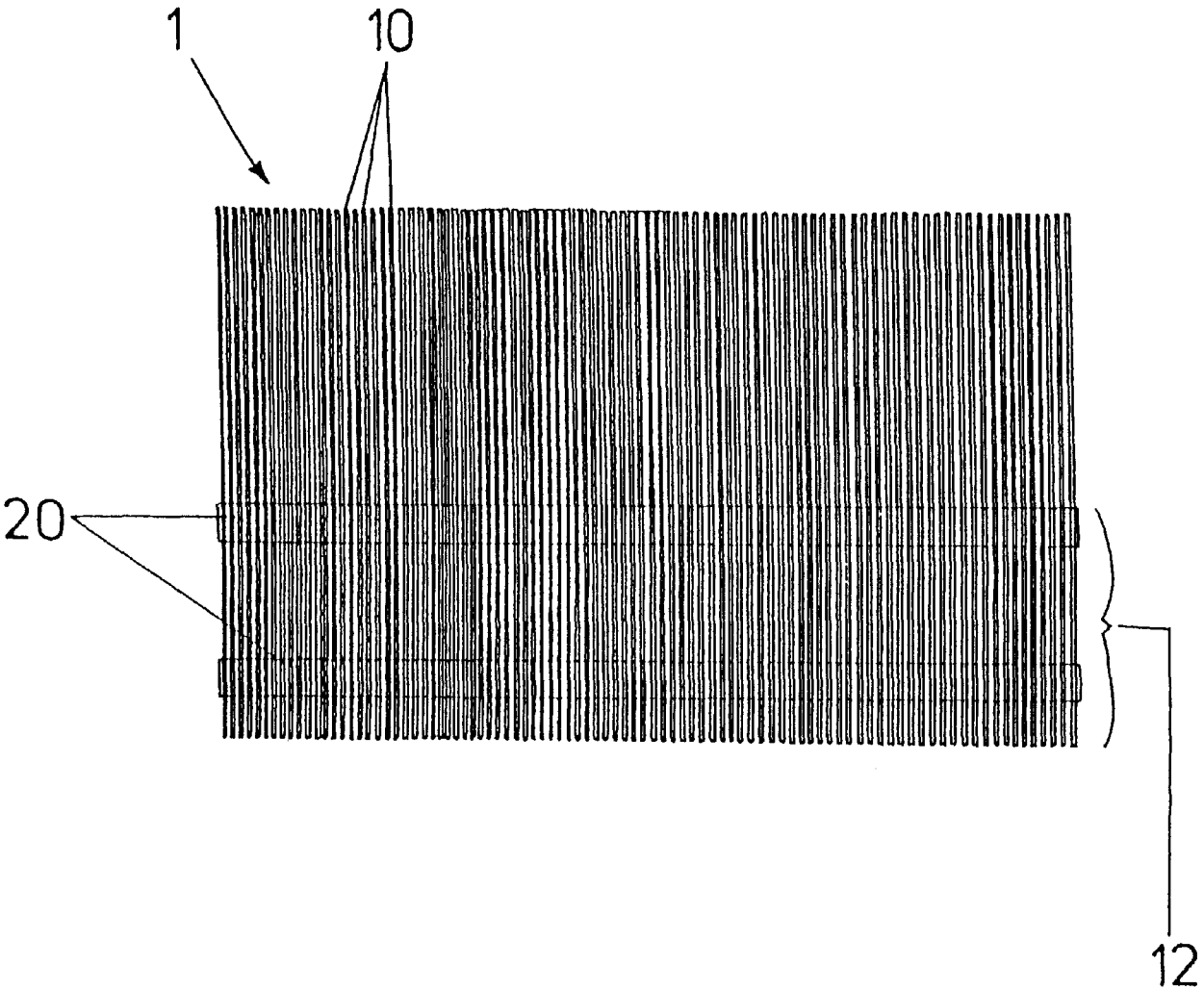

In FIG. 1 a complete sinker segment 1 is shown. This is comprised of a number of loop forming elements 10, which are provided equidistant, that is, with a pre-determined separation, and are oriented exactly parallel. They are connected to each other by means of two strands 20 of a hardenable adhesive material in the area of a base segment 12. The adhesive strands 20 run parallel to each other and perpendicular to the longitudinal direction of the elements 10.

As seen particularly from FIG. 2, each foot or base segment 12 exhibits two spaced apart holes 14. The adhesive strands 20 are formed by direct injection of an adhesive material, for example a two-component epoxy resin, in the holes 14 by means of a dosing device. The adhesive strands 20 are so precisely deposited, that they do not require any follow-up work after hardening. It is thus basically only necessary to secure the elements 10 in a partitioning comb for such a period of time until the injected adhesive is sufficiently hardened, such that the elements 10 securely maintain their position.

In the base area 12 triangular recesses are provided, which make possible a form-fitting engagement or mounting in a correspondingly designed bar or billet. The segment 1 can therewith be secured directly to the textile machine as a self-supporting segment. A holder as conventionally employed can thus be completely dispensed with.

Reference Number List

1 Sinker segment
10 Loop-forming element
12 Base segment
14 Hole
16 Recess
20 Adhesive strand

What is claimed is:

1. A sinker segment (1) for a textile machine, comprising a number of loop-forming elements (10), which are provided evenly spaced and oriented parallel to each other, said elements having a base segment (12), said elements respectively connected to each other in the area of the base segment (12) by one or more strands (20) of a hardenable adhesive, said segment (1) adapted for direct securing to a textile machine.

2. A segment according to claim 1, wherein at least two strands of adhesive material (20) run parallel to each other and perpendicular to the longitudinal direction of the elements (10).

3. A segment according to claim 1, wherein each base segment (12) exhibits holes (14) or areas with material removed, through which pass strands of adhesive material (20).

4. A segment according to claim 1, wherein the adhesive strands (20) are comprised of a construction adhesive.

5. A segment as in claim 4, wherein said construction adhesive is a two-component epoxy resin.

6. A segment according to claim 3, wherein the adhesive strands (20) are formed by direct injection into the holes (14) via a dosing device.

7. A segment according to claim 1, wherein the base segments (12) include a recess (16) for forming a form-fitting, flush interface with a corresponding feature on the textile machine.

8. A segment according to claim 7, wherein the recess (16) is in the form of a generally triangular notch.

9. A segment according to claim 7, wherein recess (16) is in the form of a dovetail.

* * * * *